US009328501B1

(12) United States Patent
Harris et al.

(10) Patent No.: US 9,328,501 B1
(45) **Date of Patent: *May 3, 2016**

(54) USE DEVICES FOR MECHANICALLY SECURED BLOCK ASSEMBLY SYSTEMS

(71) Applicant: 3B Construction Solutions, Inc., Anderson, IN (US)

(72) Inventors: J Kevin Harris, Nashville, IN (US); Dan Ertl, Anderson, IN (US); John D Ritchison, Anderson, IN (US); Roger F. Marsh, Anderson, IN (US)

(73) Assignee: 3B CONSTRUCTION SOLUTIONS, INC., Anderson, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/551,665

(22) Filed: Nov. 24, 2014

Related U.S. Application Data

(63) Continuation of application No. 14/098,440, filed on Dec. 5, 2013, now Pat. No. 8,893,447, and a continuation-in-part of application No. 11/353,253, filed on Feb. 13, 2006, now Pat. No. 9,206,597.

(60) Provisional application No. 61/733,536, filed on Dec. 5, 2012.

(51) Int. Cl.

| | |
|---|---|
| ***E04C 5/08*** | (2006.01) |
| ***E04B 1/04*** | (2006.01) |
| ***E04B 1/58*** | (2006.01) |
| ***E04B 2/18*** | (2006.01) |

(Continued)

(52) U.S. Cl.
CPC ..... *E04B 1/043* (2013.01); *E04B 1/5825* (2013.01); *E04B 2/18* (2013.01); *E04B 5/08* (2013.01); *E04B 7/00* (2013.01); *E04C 1/00* (2013.01); *E04C 5/06* (2013.01); *E04C 5/162* (2013.01); *E04B 2001/5887* (2013.01); *E04B 2001/5893* (2013.01); *E04B 2002/0247* (2013.01); *E04B 2002/0297* (2013.01)

(58) Field of Classification Search
CPC ..... E04B 1/043; E04B 1/5825; E04B 2/18; E04B 5/08; E04B 7/00; E04B 2001/5887; E04B 2001/5893; E04B 2002/0247; E04B 2002/0297; E04C 1/00; E04C 5/06; E04C 5/162
USPC ..... 52/223.7, 223.13, 223.5, 253, 285.2, 52/293.3, 293.2, 431, 600
See application file for complete search history.

(56) References Cited

U.S. PATENT DOCUMENTS

| | | | |
|---|---|---|---|
| 838,844 | A | 12/1906 | Clayton |
| 952,305 | A | 3/1910 | Buskirk |

(Continued)

*Primary Examiner* — Brian Mattei
(74) *Attorney, Agent, or Firm* — C. John Brannon; Brannon Sowers and Cracraft PC

(57) ABSTRACT

An improved mechanically secured block building system generally for concrete masonry structures comprising a masonry block unit with a height and width essentially one-half the length of the unit, with multiple cavities through the block and with a recessed channel; an anchor bar with a plurality of threaded and non-threaded apertures in a special configuration to match the cavities in the block unit and able to lay in the recessed channel of the block; and a fastener wherein the mechanical secured block building system can be assembled in unique ways due to a cube effect of the masonry block to construct multiple width walls, grade beams, and horizontal decks. An alternative embodiment includes the preferred mechanical secured block building system further comprised of (d) a footer block and (e) a footer plate.

8 Claims, 16 Drawing Sheets

138

(51) Int. Cl.

| | |
|---|---|
| ***E04C 1/00*** | (2006.01) |
| ***E04C 5/06*** | (2006.01) |
| ***E04B 5/08*** | (2006.01) |
| ***E04B 7/00*** | (2006.01) |
| ***E04C 5/16*** | (2006.01) |
| *E04B 2/02* | (2006.01) |

(56) References Cited

U.S. PATENT DOCUMENTS

| | | | | |
|---|---|---|---|---|
| 962,463 | A | 6/1910 | Phillips | |
| 1,496,754 | A * | 6/1924 | Eaves | 52/503 |
| 1,753,451 | A | 4/1930 | Tonnelier | |
| 1,783,383 | A | 12/1930 | Montrief | |
| 1,892,605 | A | 12/1932 | Betzler | |
| 2,141,397 | A | 12/1938 | Locke | |
| 2,212,184 | A | 8/1940 | Powell | |
| 2,250,763 | A | 7/1941 | Hild | |
| 2,929,236 | A | 3/1960 | Stewart et al. | |
| 2,963,828 | A | 12/1960 | Belliveau | |
| 3,236,545 | A | 2/1966 | Parkers et al. | |
| 3,295,286 | A | 1/1967 | Schaich | |
| 3,296,758 | A | 1/1967 | Knudsen | |
| 3,382,632 | A | 5/1968 | Grofcsik | |
| 3,410,044 | A | 11/1968 | Gerhard | |
| 3,511,000 | A | 5/1970 | Keuls | |
| 3,763,609 | A | 10/1973 | Probst | |
| 3,785,097 | A | 1/1974 | Seymour | |
| 4,094,222 | A | 6/1978 | Lang et al. | |
| 4,569,167 | A | 2/1986 | Staples | |
| 4,640,071 | A | 2/1987 | Haener | |
| 4,726,567 | A | 2/1988 | Greenberg | |
| 4,757,656 | A | 7/1988 | Powers, Jr. | |
| 4,854,097 | A | 8/1989 | Haener | |
| 5,007,218 | A | 4/1991 | Bengtson et al. | |
| 5,511,902 | A | 4/1996 | Center | |
| 5,589,124 | A | 12/1996 | Woolford et al. | |
| 5,802,792 | A | 9/1998 | Fielding et al. | |
| 5,809,732 | A | 9/1998 | Farmer, Sr. et al. | |
| 5,924,254 | A | 7/1999 | Franklin et al. | |
| 5,941,565 | A | 8/1999 | Clendenin, Jr. | |
| 5,950,319 | A | 9/1999 | Harris | |
| 6,065,265 | A | 5/2000 | Stenekes | |
| 6,098,357 | A | 8/2000 | Franklin et al. | |
| 6,138,426 | A * | 10/2000 | Mork et al. | 52/562 |
| 6,167,669 | B1 | 1/2001 | Lanc | |
| 6,178,714 | B1 | 1/2001 | Carney, Jr. | |
| 6,244,785 | B1 | 6/2001 | Richter et al. | |
| 6,282,859 | B1 | 9/2001 | Van Der Heidjen | |
| 6,321,498 | B1 | 11/2001 | Trovato | |
| 6,427,390 | B1 | 8/2002 | Thies | |
| 6,431,797 | B2 | 8/2002 | Greenberg | |
| 6,513,296 | B1 | 2/2003 | Baden | |
| 6,557,316 | B2 | 5/2003 | Van Der Heidjen | |
| 6,632,048 | B2 | 10/2003 | Greenberg | |
| 6,665,992 | B2 | 12/2003 | Hew | |
| 6,691,471 | B2 | 2/2004 | Price | |
| 6,758,020 | B2 | 7/2004 | Cerrato | |
| 6,904,728 | B2 | 6/2005 | Stutts | |
| 6,915,614 | B2 | 7/2005 | Matsufuji | |
| 6,955,015 | B2 | 10/2005 | Manthei | |
| 7,124,550 | B1 | 10/2006 | Deming | |
| 7,415,805 | B2 | 8/2008 | Nickerson | |
| 7,461,490 | B2 | 12/2008 | Toledo | |
| 7,934,345 | B2 | 5/2011 | Marsh et al. | |
| 8,099,918 | B2 | 1/2012 | Marsh et al. | |
| 2002/0041796 | A1 | 4/2002 | Greenberg | |
| 2002/0134040 | A1 | 9/2002 | Hew | |
| 2004/0020145 | A1 | 2/2004 | Matsufuji | |
| 2004/0144059 | A1 | 7/2004 | Keshmiri | |
| 2005/0183362 | A1 | 8/2005 | McCarthy | |
| 2006/0168906 | A1 | 8/2006 | Tonyan et al. | |
| 2006/0201082 | A1 | 9/2006 | Hammer et al. | |
| 2007/0017176 | A1 | 1/2007 | Gray | |
| 2007/0056235 | A1 | 3/2007 | Kohler | |
| 2007/0107333 | A1 * | 5/2007 | Marsh et al. | 52/223.7 |
| 2007/0186502 | A1 | 8/2007 | Marsh et al. | |
| 2008/0098687 | A1 | 5/2008 | Marsh et al. | |
| 2008/0256894 | A1 * | 10/2008 | Marsh et al. | 52/719 |
| 2009/0188186 | A1 * | 7/2009 | Ebanks | 52/253 |
| 2009/0313923 | A1 * | 12/2009 | Bucheger | 52/223.7 |
| 2011/0013991 | A1 * | 1/2011 | Watson et al. | 405/284 |

* cited by examiner

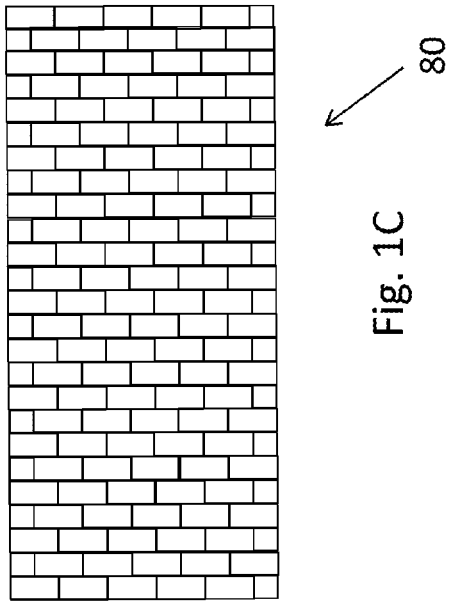
Fig. 1C
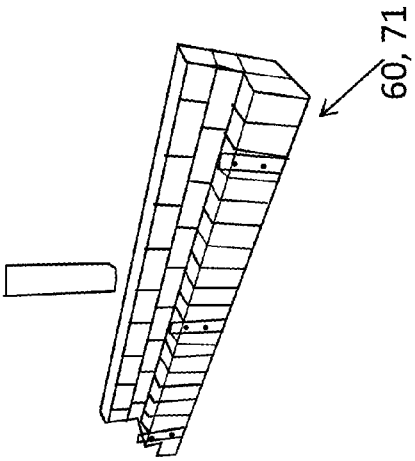
Fig. 1B
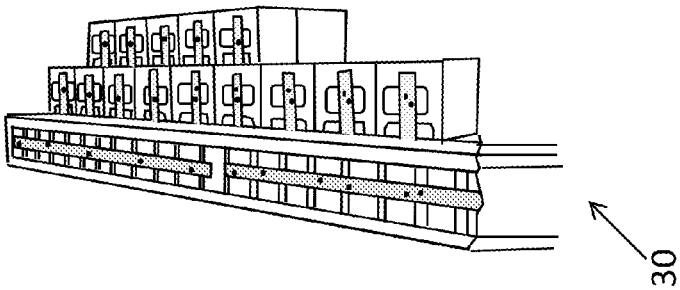
Fig. 1A
FIGS. 1

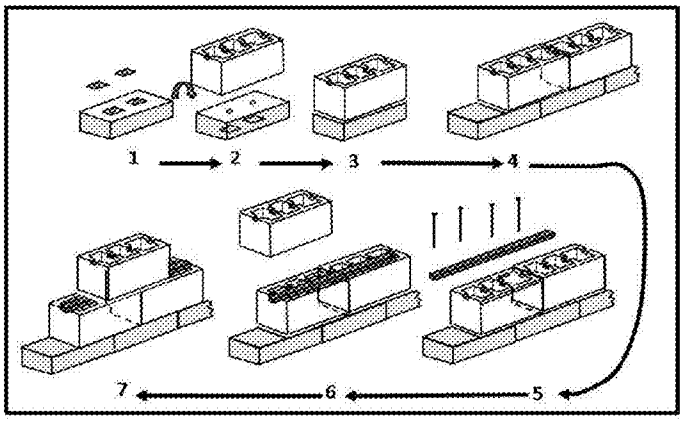
Fig. 2 C
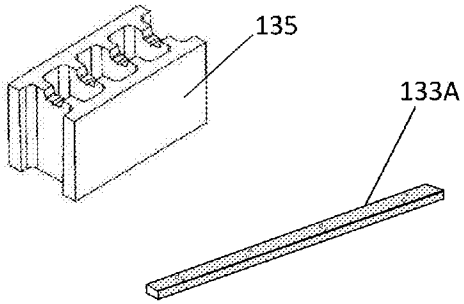
Fig. 2 A
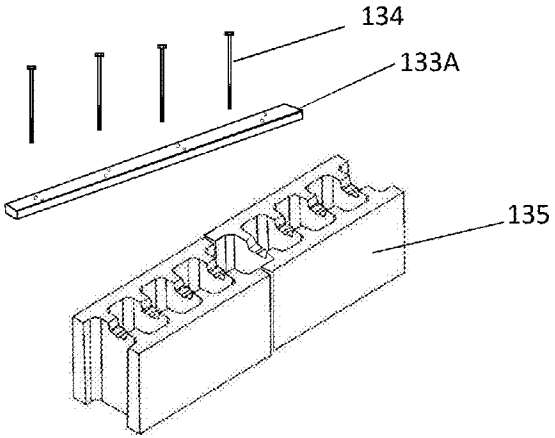
Fig. 2 B
FIGS. 2

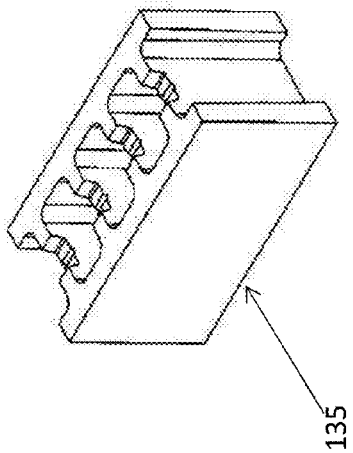
Fig. 3 D
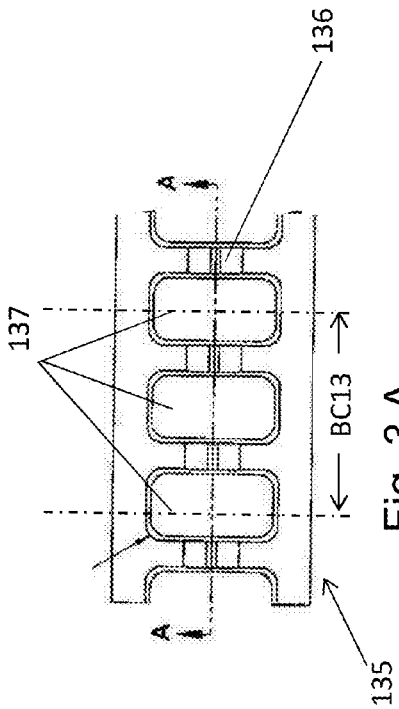
Fig. 3 A
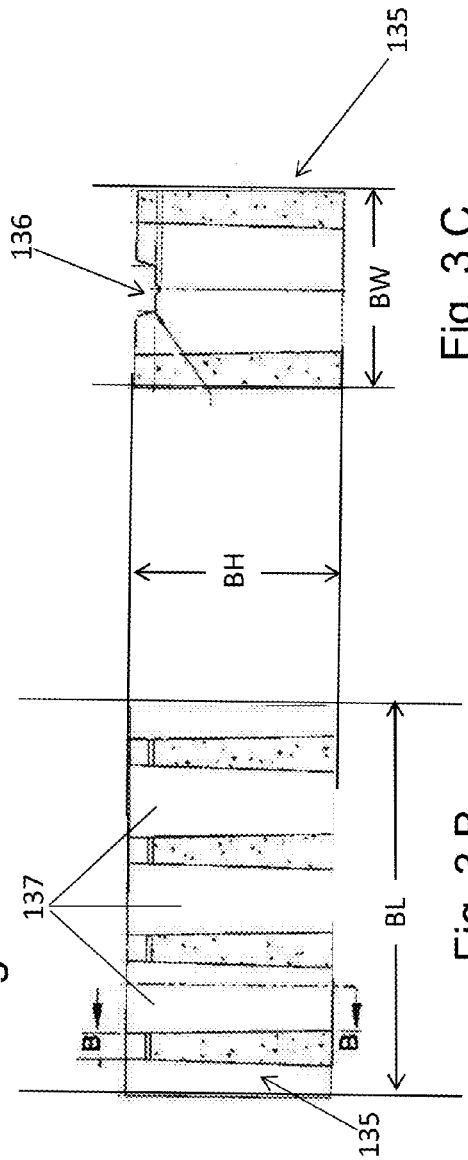
Fig. 3 C
Section B-B
Fig. 3 B
Section A-A
FIGS. 3

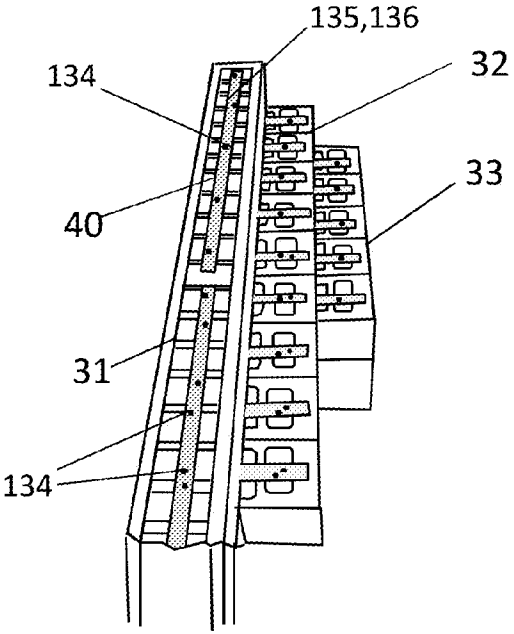
Fig. 5C
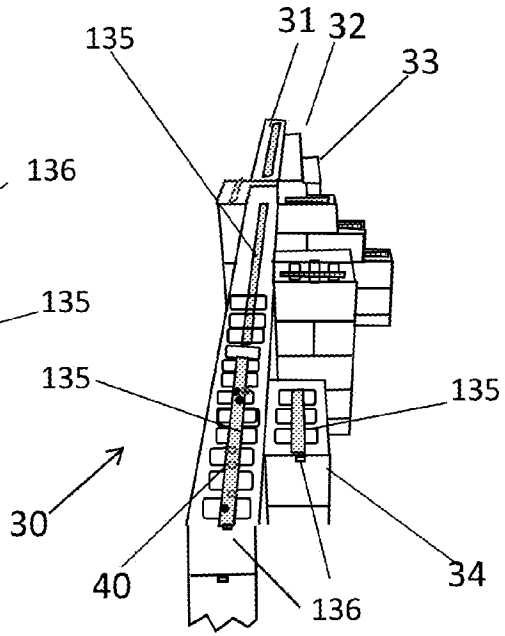
Fig. 5B
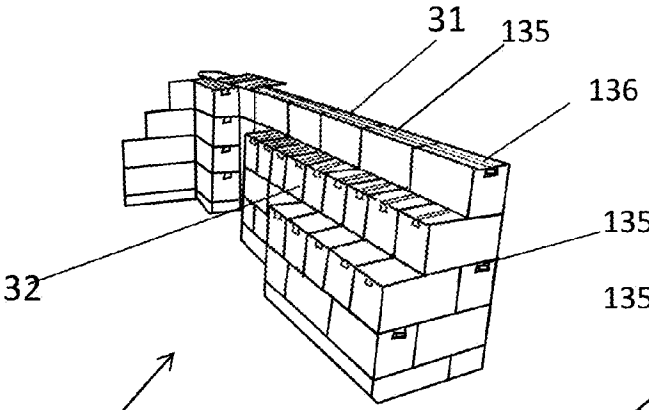
Fig. 5A
FIGS. 5

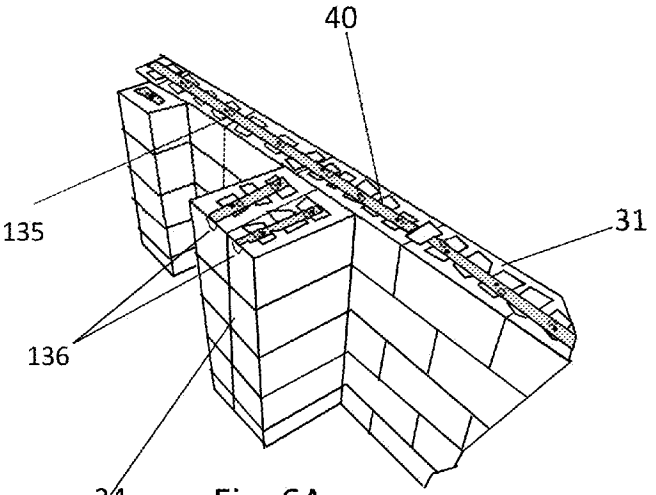
Fig. 6A
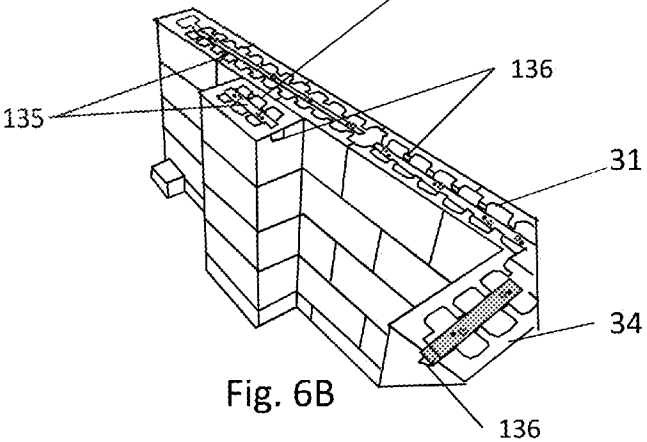
Fig. 6B
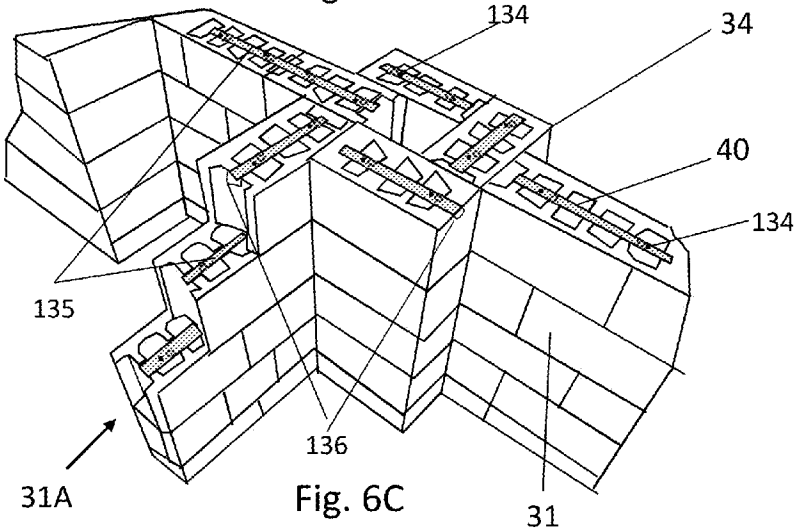
Fig. 6C
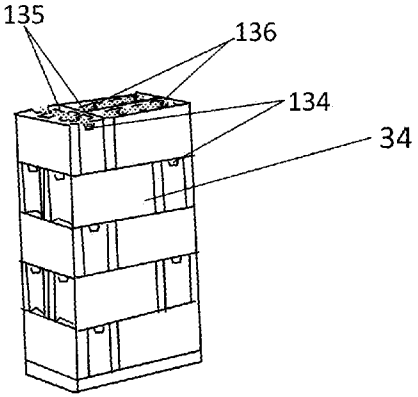
Fig. 6D
FIGS. 6

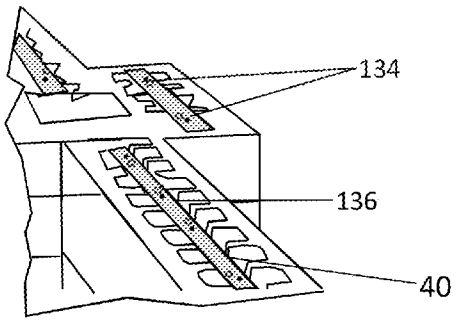
Fig. 7A
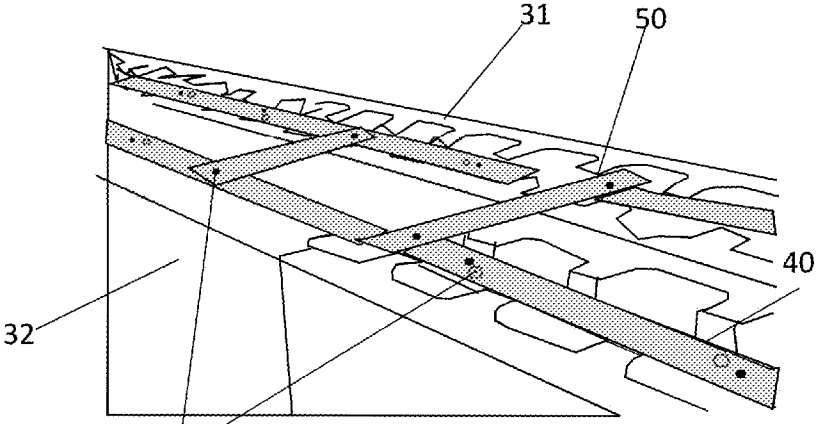
Fig. 7B
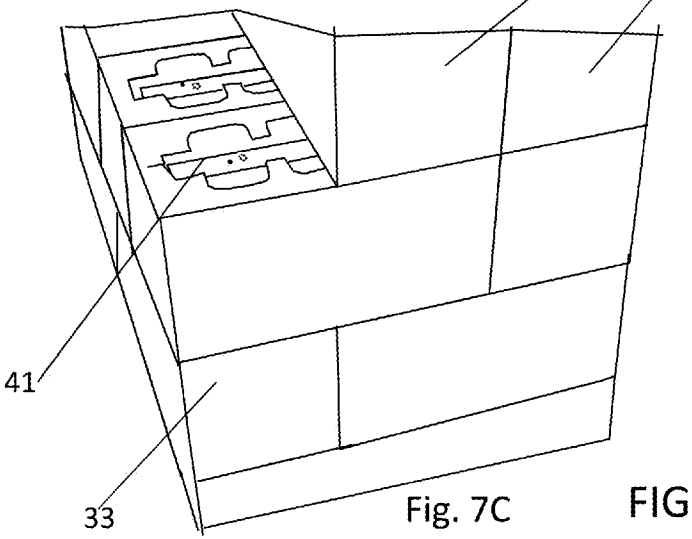
Fig. 7C
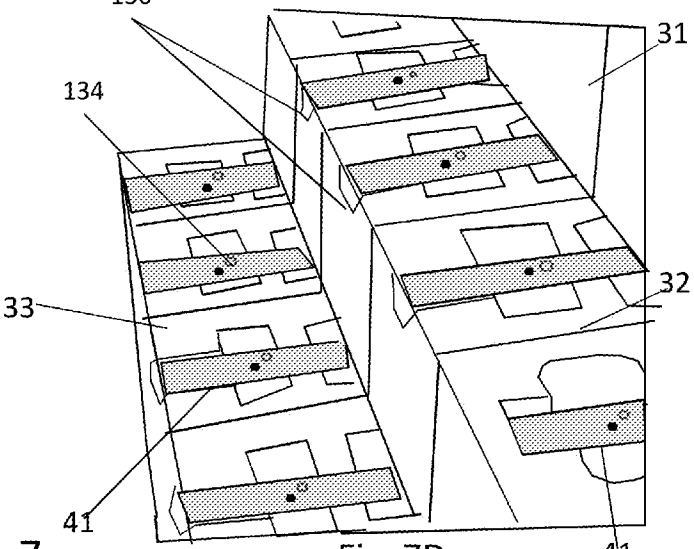
Fig. 7D
FIGS. 7

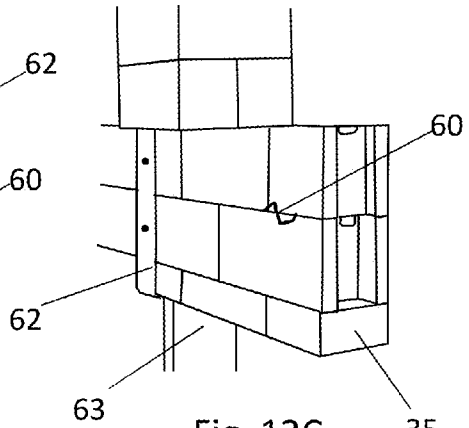
Fig. 12A
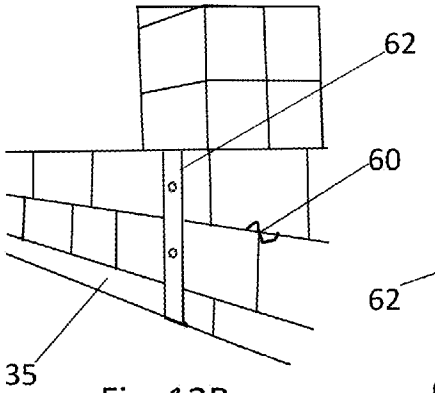
Fig. 12B
Fig. 12C
Fig. 12D
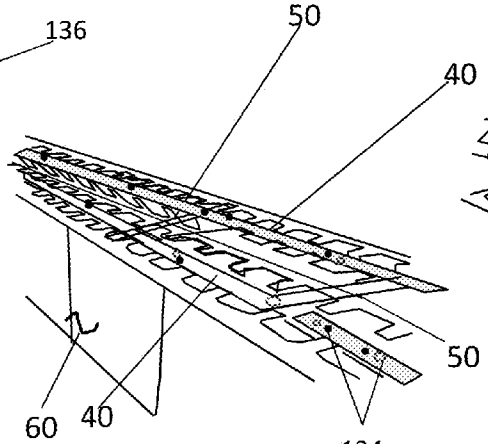
Fig. 12E
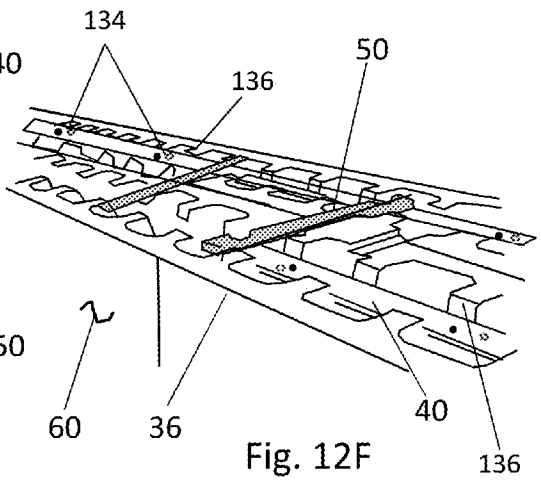
Fig. 12F
FIGS. 12

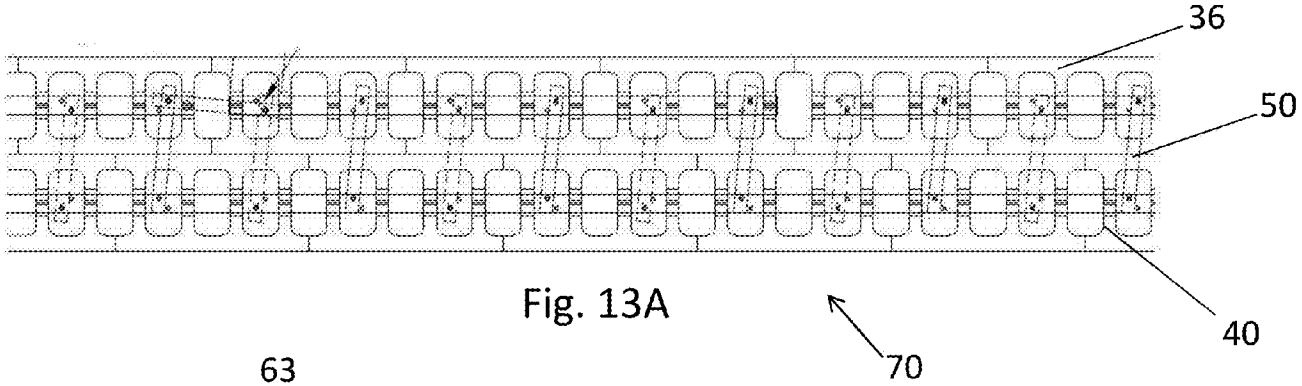
Fig. 13A
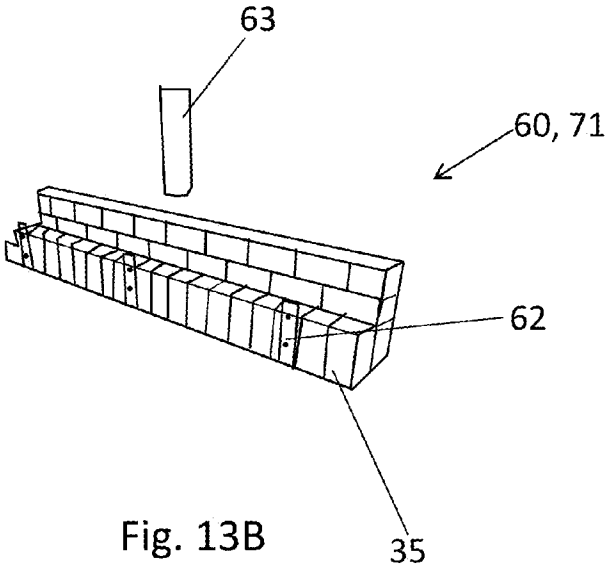
Fig. 13B
FIGS. 13

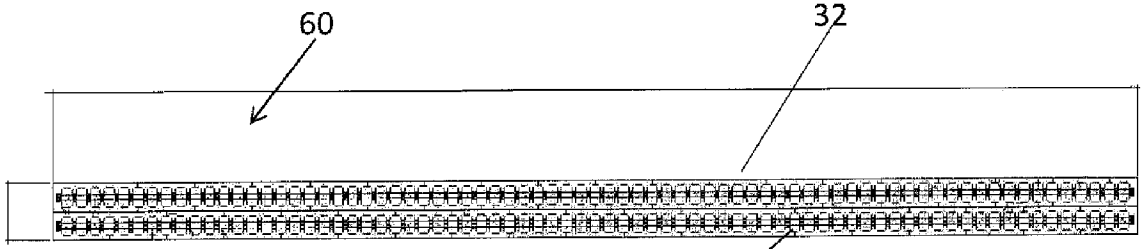
Fig. 14A
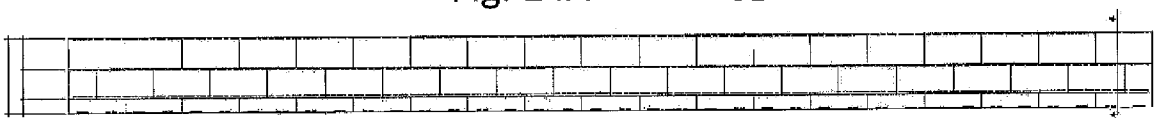
Fig. 14B
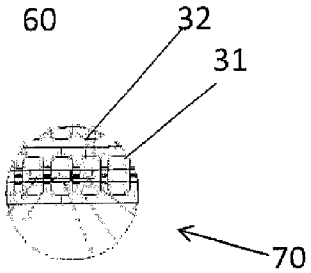
Fig. 14D
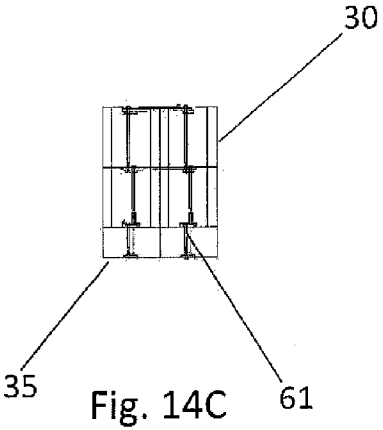
Fig. 14C
FIGS. 14

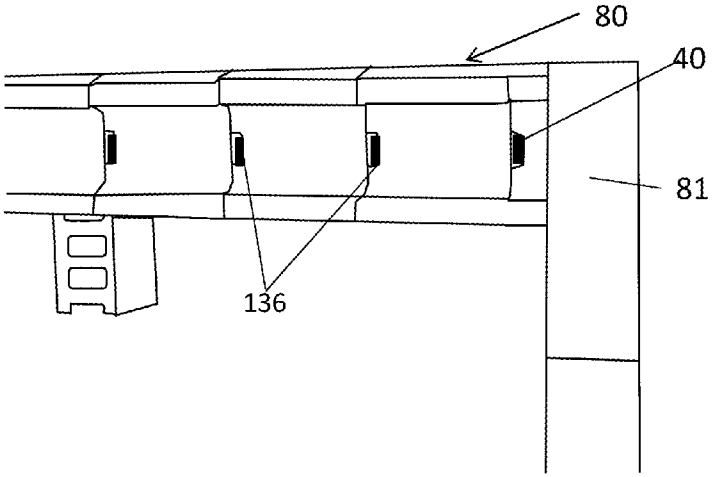
Fig. 15B
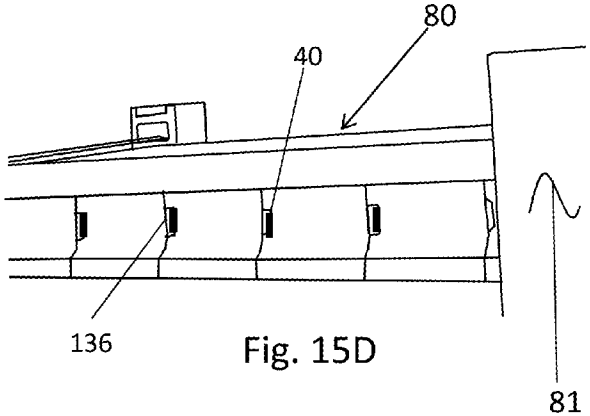
Fig. 15D
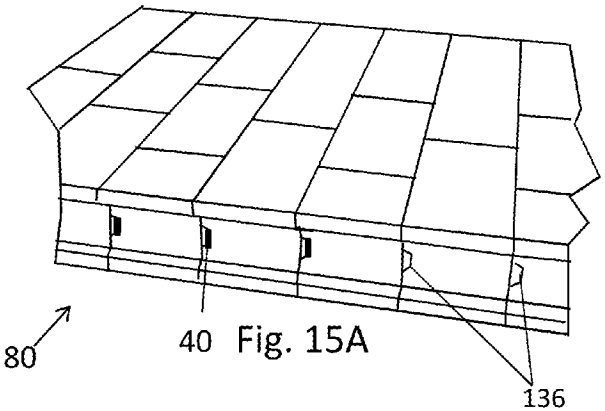
Fig. 15A
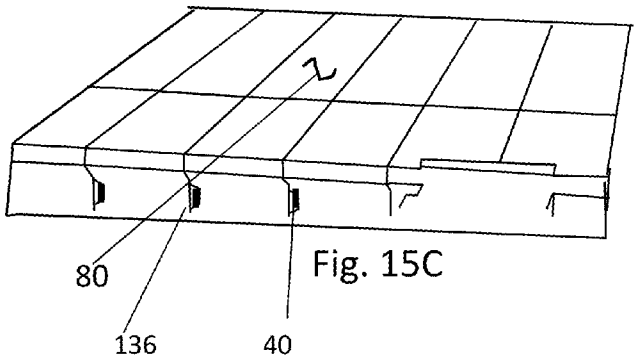
Fig. 15C
FIGS. 15

USE DEVICES FOR MECHANICALLY SECURED BLOCK ASSEMBLY SYSTEMS

CROSS-REFERENCE TO RELATED APPLICATIONS

This application is a continuation of and claims priority to copending U.S. patent application Ser. No. 14/098,440, filed on Dec. 5, 2013, which claimed the benefit of then U.S. Provisional Patent Application Ser. No. 61/733,536 filed Dec. 5, 2012, and is a continuation-in-part of and claims priority to copending U.S. patent application Ser. No. 11/353,253, filed on Feb. 13, 2006.

FIELD OF NOVEL TECHNOLOGY

Embodiments of the present novel technology relate generally to construction materials, and, more particularly, to unitized post tension systems and methods for concrete masonry structures.

BACKGROUND

Existing unitized post tension systems for concrete masonry structures have until now required special other construction to address larger wall widths over approximately eight inches, to address horizontal decks and to address structural grade beams. The existing taught systems did not easily accommodate those needs in a unitized post tension system.

The prior art unitized post tension systems address methods and systems to rapidly build structures, including walls with for use as flat deck, wider wall systems and large grade beams. Recent unitized post tension systems facilitated improvements to traditional construction systems and their limitations. The recent systems do not require special skills to construct; does not need water and power; do not require elaborate bracing; provides immediate occupancy or use; needs no curing time; and are re-useable if desired since it is not destroyed when disassembled and moved. While the recent systems are improvements to decrease the time to build or rebuild areas with minimal skilled labor and provide a far superior and more consistent strength structure than the traditional mortar constructed structure, these systems still have room for improved devices and configurations to meet known shortcomings. The problems and limitations of the prior art unitized post tension systems are addressed generally for the use as flat deck, wider wall systems and large grade beams. In the building industry, the masonry, precast concrete and poured in place, tilt-up wall systems often accompany a building type—industrial, commercial, and hi-rise residential—where floor and roof decks are utilized. For example, motel and hotels and office buildings, strip malls and the like will incorporate precast decks or poured in place steel sheet metal and concrete to provide floors and roof decks. Therefore an alternative flat decking means from the unitized post tension system is desirable.

The unitized post tension system has also found acceptance in the southern building needs in Mississippi and Louisiana. In those locations, the rapid build system afforded by unitized post tension systems still had restrictions with the need for grade beams to be used in the quasi-marsh areas in cooperation with posts or pilings. Here the spans were of such lengths that some consideration for higher tension strength in the grade beams presented some challenges to the unitized post tension system. Therefore a better adapted and improved grade beam made of unitized post tension components with added features and capabilities is desirable.

The final desired improvement to unitized post tension systems is not an intuitively obvious need. In the concrete masonry unit (CMU) building systems, the approximately eight inch wide block is the main component. However, over the years, the need for ten inch, twelve inch and larger widths became evident. These were addressed by the industry to provide wide base walls. However, these wider block came at a price: they required all new, wider molds to produce; they were much heavier and usually required two people to lift and transport, and they often needed additional tooling and accessories to match the wider widths. Therefore, it is desirable to build wider, higher capacity wall systems from the unitized post tension components. The new system that addresses this will save the cost of molds, added labor and employee fatigue, and added costs for the wider blocks. However, the new use of the unitized post tension components would need to be as strong or even stronger than the CMU counterparts. These problems or limitations of the desires for the use as flat deck, wider wall systems and large grade beams are described below.

Historically, no known devices have attempted to address the problem as stated. The building industry has made little progress for a unitized, post tension system so improvements to the recent unitized post tension systems have not yet been attractive to promotion of the technology. Even so, blocks have required very special and often complex configurations to even handle rods and plates and then they have taught only limit rods in special blocks. One such device is an instant levy block system. This is a complex, specially made block for constructing a levy, comprising a plurality of blocks, a plurality of connecting pegs, and a plurality of stakes. Each part is uniquely designed and made whereas the novel technology uses a commonly made block designed for the common bars and bolts. Another block device is a masonry block with an embedded plate. The concrete masonry block has an external plate or plates that are anchored through the concrete masonry block. The external plates are cast into the concrete masonry block in the mold during casting. These plates and metal pieces are not taught as being part of a post tensioning system now shown cast within the hollow cavities as addressed by the improved novel technology.

Another device for construction is a modular pre-cast construction block system with a wall subsystem and a foundation subsystem. The wall subsystem has a number of wall units having cavities and pre-stressed tension cables are cast therein the cavity. This teaches precast walls and pass through cable which are specially made, require water, and are not readily re-useable like the novel technology. A somewhat re-useable system includes long rods that extend through apertures in the specially cast block and the precast structures. No description of pre or post tensioning is taught or claimed. The configuration of special length rods, special blocks, special plates and a complex system that requires powered equipment to construct is unlike the novel technology.

One known mortarless wall structure comprises columns of preformed, lightweight, stacked blocks, with the columns of blocks connected to each other by elongated, vertically oriented, support beams. Preferably, the wall structure is operatively connected to a structure by one or more brackets. The beams and blocks are special configuration, not readily available and with limited uses. These are complex and do not anticipate the novel technology.

An interlocking, mortar less system is accomplished by some other devices. However, none of them are found to show a structural unitized post tensioning system as described for the novel technology in the materials below. An example of one such interlocking device is a block of concrete or the like for use in constructing a mortar less wall. The device provided includes a spaced parallel pair of upright sidewalls having flat bottoms and tops and bearing integral block interlocking connectors and various configurations on their opposite ends. The sidewalls are integrally connected by means of these configurations. This is not the configuration taught by the novel technology. Another motarless system is a set of superimposed building blocks with vertically spaced flat bars interfitted with the blocks and studs inserted through one bar and then threaded into engagement with bars of lower blocks.

None of the prior art found with a rigorous search teaches all the features and capabilities of the novel technology. As far as known, there are no systems at the present time which fully meet the need for a unitized, post-tensioned masonry block structure with the described shortfalls which are now resolved by the present novel technology. It is believed that this system is made with component parts, is built with simple tools, and provides a much stronger structure than prior art devices and systems.

SUMMARY

This technology relates to new modifications and uses of a bolt and bar, mechanically secured block system. New use devices include multi width walls, horizontal decks and structural beams such as grade beams. Taught here are the ways to significantly improve and expand the use of mechanically secured block far beyond anticipation of current/prior art devices nor obvious to one skilled in the art of block construction—mechanical or otherwise.

One preferred embodiment of the uses for the novel technology are shown in the drawings and further described below. The embodiment is a mechanical secured block building system for constructing structures with concrete masonry units, the system comprising: (a) a masonry block unit with a height and width essentially one-half the length of the unit, with multiple cavities through the block and with a recessed channel; (b) an anchor bar with a plurality of threaded and non-threaded apertures in a special configuration to match the cavities in the block unit and able to lay in the recessed channel of the block; and (c) a fastener wherein the mechanical secured block building system can be assembled in unique ways due to a cube effect of the masonry block to construct multiple width walls, grade beams, and horizontal decks. An alternative embodiment includes The mechanical secured block building system is further comprised of: (d) a footer block and (e) a footer plate.

BRIEF DESCRIPTION OF THE DRAWINGS

The accompanying drawings, which are incorporated in and constitute a part of this specification, illustrate embodiments of the novel technology. The drawings together with the summary description given above and a detailed description given below serve to explain the principles of the construction system. It is understood, however, that the novel technology for block construction systems is not limited to only the precise arrangements and instrumentalities shown. While multiple embodiments are disclosed, still other embodiments of the present novel technology will become apparent to those skilled in the art from the following detailed description, which shows and describes illustrative embodiments of the novel technology. Accordingly, the drawings and detailed description are to be regarded as illustrative in nature and not restrictive.

FIG. 1A is a first perspective view of general mechanical block special enhancements, of multi walls, grade beams and horizontal beam/slabs.

FIG. 1B is a second perspective view of general mechanical block special enhancements, of multi walls, grade beams and horizontal beam/slabs.

FIG. 1C is a third elevation view of general mechanical block special enhancements, of multi walls, grade beams and horizontal beam/slabs.

FIG. 2A is a first perspective view of mechanical systems for unitized post tensioning block, bar and fastener components plus a method to assemble a typical wall from the prior art.

FIG. 2B is a second perspective view of mechanical systems for unitized post tensioning block, bar and fastener components plus a method to assemble a typical wall from the prior art.

FIG. 2C is a third schematic perspective view of mechanical systems for unitized post tensioning block, bar and fastener components plus a method to assemble a typical wall from the prior art.

FIG. 3A is a first partial top plan view of a mechanical system for unitized post tensioning.

FIG. 3B is a second side plan view of a mechanical system for unitized post tensioning.

FIG. 3C is a third end plan view of a mechanical system for unitized post tensioning.

FIG. 3DA is a fourth perspective view of a mechanical system for unitized post tensioning.

FIG. 5A is a first perspective view of the general mechanical secured block building system (MSB) wall system walls single, double, and triple.

FIG. 5B is a second perspective view of the general mechanical secured block building system (MSB) wall system walls single, double, and triple.

FIG. 5C is a third perspective view of the general mechanical secured block building system (MSB) wall system walls single, double, and triple.

FIG. 6A is a first perspective view of additional multi walls and piers for the MSB wall system.

FIG. 6B is a second perspective view of additional multi walls and piers for the MSB wall system.

FIG. 6C is a third perspective view of additional multi walls and piers for the MSB wall system.

FIG. 6D is a fourth perspective view of additional multi walls and piers for the MSB wall system.

FIG. 7A is a first perspective view of MSB walls and components.

FIG. 7B is a second perspective view of MSB walls and components.

FIG. 7C is a third perspective view of MSB walls and components.

FIG. 7D is a fourth perspective view of MSB walls and components.

FIG. 12A is a first perspective view of the grade beams made from MSB.

FIG. 12B is a second perspective view of the grade beams made from MSB. FIG. 12C is a third perspective view of the grade beams made from MSB. FIG. 12D is a fourth perspective view of the grade beams made from MSB. FIG. 12E is a fifth perspective view of the grade beams made from MSB. FIG. 12F is a sixth perspective view of the grade beams made from MSB.

FIG. 13A is a first top plan view of a grade beam.

FIG. 13B is a second perspective view of a grade beam.

FIG. 14A is a first engineering drawing of the grade beams from MSB.

FIG. 14B is a second engineering drawing of the grade beams from MSB.

FIG. 14C is a third engineering drawing of the grade beams from MSB.

FIG. 14D is a fourth engineering drawing of the grade beams from MSB.

FIG. 15A is a first perspective view of horizontal Beams/Slabs of the MSB system.

FIG. 15B is a second perspective view of horizontal Beams/Slabs of the MSB system.

FIG. 15C is a third perspective view of horizontal Beams/Slabs of the MSB system.

FIG. 15D is a fourth perspective view of horizontal Beams/Slabs of the MSB system.

FIG. 16B1 is a second elevation of the horizontal beam/slabs for MSB systems.

FIG. 16B2 is a third partial elevation of the horizontal beam/slabs for MSB systems.

FIG. 16C1 is a fourth elevation of the horizontal beam/slabs for MSB systems.

FIG. 16C2 is a fifth partial elevation of the horizontal beam/slabs for MSB systems.

Figure 4:
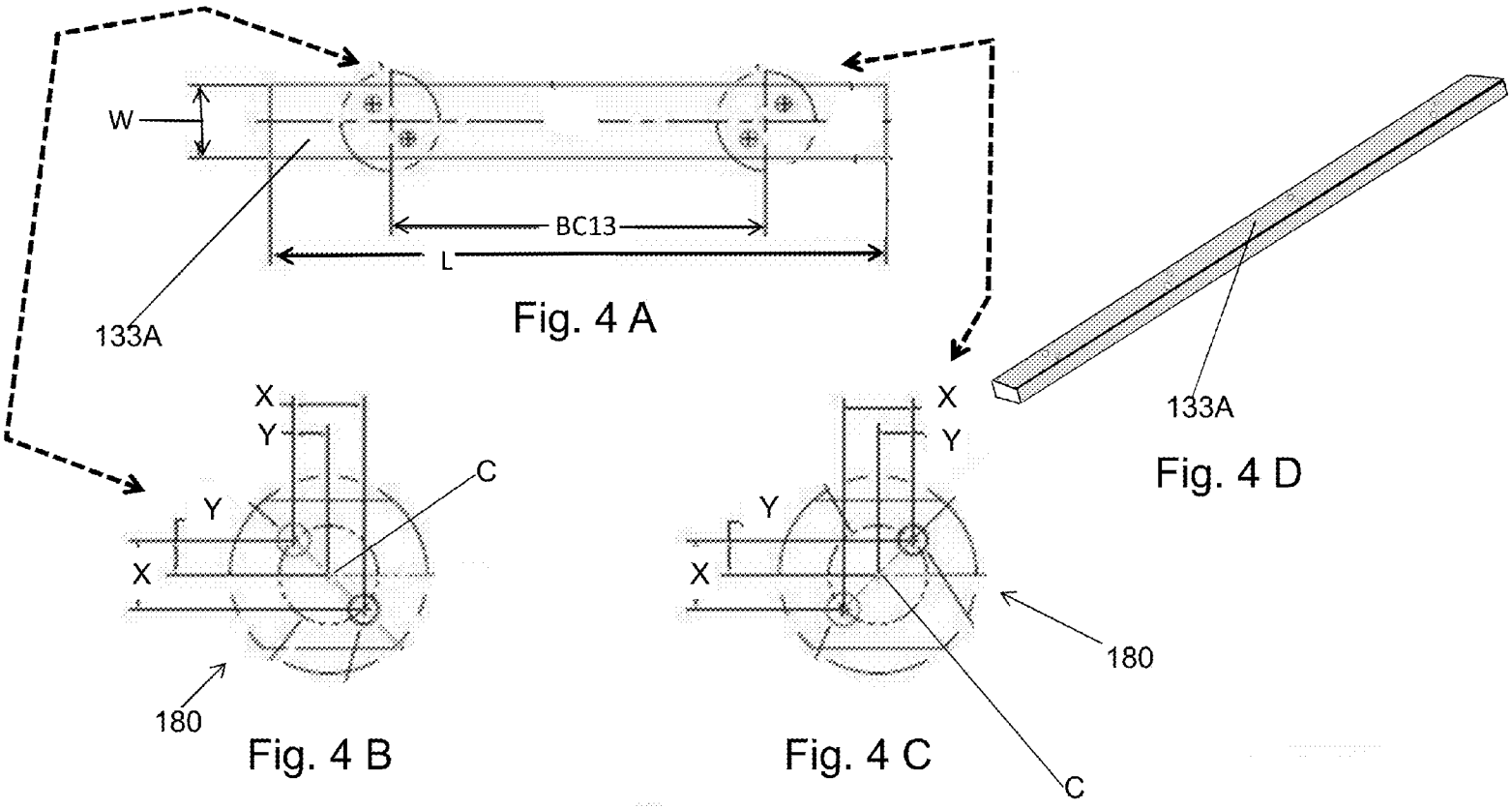
FIG. 4A is a first plan view of the bars for the mechanical systems for unitized post tensioning building systems.
FIG. 4B is a second end view of the bars for the mechanical systems for unitized post tensioning building systems.
FIG. 4C is a third end view of the bars for the mechanical systems for unitized post tensioning building systems.
FIG. 4D is a fourth perspective view of the bars for the mechanical systems for unitized post tensioning building systems.

While the novel technology is amenable to various modifications and alternative forms, specific embodiments have been shown by way of example in the drawings and are described in detail below. The intention, however, is not to limit the novel technology to the particular embodiments described. On the contrary, the novel technology is intended to cover all modifications, equivalents, and alternatives falling within the scope of the novel technology as defined by the appended claims.

DESCRIPTION OF THE DRAWINGS

Reference Numerals

The following list refers to the drawings reference numbers:

| Ref # | Description |
|---|---|
| 30 | multi Width Mechanical Block Walls |
| 31 | single wall MSB |
| 31A | tee wall |
| 32 | double walled MSB |
| 33 | triple walled MSB |
| 34 | MSB pier |
| 35 | MSB footer |
| 36 | MSB single block |
| 40 | bar with securing features (such as through hole and threaded aperture) |
| 41 | perpendicular bar |
| 50 | link bar |
| 60 | grade beams (GB) for Mechanically Held Block Walls |
| 61 | long bars for grade beams |
| 62 | cradle |
| 63 | post or piling |
| 64 | rebar in piers |
| 65 | void where grouted |
| 70 | engineering drawing of grade beams |
| 71 | sketch of actual prototype in field |
| 80 | horizontal assembly for Mechanically Held Block Walls |
| 81 | vertical support walls or horizontal beams (longitudinal or lateral) |
| 82 | top floor or roof membrane |
| 133 | anchor for post tensioning such as a bar with connection features of angled alignment comprised of smooth through holes and internally threaded apertures |
| 133 | Arelatively longer anchor bar compared to unit bar (33) |
| 134 | tendon for post tensioning such as a bolt or other fastener |
| 135 | concrete masonry unit with recess channels and three full cores and 2 half cores (ducts} |
| 136 | extended recess channels |
| 137 | duct or cavity in the block |
| 138 | general process for the new art |
| 180 | bar/anchor aperture pattern |
| X | one Distance from center point |
| Y | second Distance from center point |
| C | center Point |
| W | anchor bar width |
| L | anchor bar length |
| BC13 | distance from centerline of core 1 and core 3 and center points C of anchor bar apertures |
| BL | block length |
| BW | block width = approximately 1/2 block length |
| BH | block height = Block width = approximately 1/2 block length |

DETAILED DESCRIPTION

The present novel technology relates to new use devices for Mechanically Secured Block (MSB) Assembly Systems. Embodiments of the present novel technology relate to generally to systems and methods for concrete masonry structures, and more particularly to unitized post tension systems and methods for concrete masonry structures. The present novel technology relates generally to all types of general construction where a common mortar and hollow block or brick combination is utilized and relates to other construction means, such as reinforced concrete, for structures as well. The embodiments of the Novel technology are shown in the accompanying sketches and described below.

There is shown in FIGS. 1-16 a complete description and operative embodiment of the novel technology. In the drawings and illustrations, FIGS. 1-13 demonstrate the general configuration and use of this product/system. The various example uses are in the operation and use section, below.

The accompanying drawings, which are incorporated in and constitute a part of this specification, illustrate an embodiment of the novel technology that are preferred. The drawings together with the summary description given above and a detailed description given below serve to explain the principles of the construction system and devices. It is understood, however, that the novel technology are not limited to only the precise arrangements and instrumentalities shown. Other examples of similar construction systems within this same scope are still understood by one skilled in the art of construction systems, directly or indirectly associated with block systems, to be within the scope and spirit shown here.

The examples and not limits to the advantages of the new device uses of the system are:

A. Permits a way to create long beams, especially grade beams;

B. Provides cubing of the piers in the building systems with block width=block height=½ block length;

C. Establishes a manner to provide multiple width walls that are integrally tied together for greater strength and durability;

D. Reduces the cost of wider walls by using one common unit (approximately 16×8×8 inch) rather than 10 or 12 inch widths. This reduces of molds, accessories and labor to handle larger block units;

E. Allows for horizontal decks, floors and cantilevered building assemblies; and F. Capitalizes on the new mechanical block assembly systems and removes the need to use other construction methods for decks, grade beams and wider wall assemblies.

One embodiment is a mechanical secured block building system for constructing structures with concrete masonry units, the system comprising: (a) a masonry unit, the masonry unit being made of concrete and comprising: a masonry longitudinal length, a masonry width measured perpendicularly to the masonry longitudinal length, wherein the masonry width which is essentially one half the longitudinal length and which is substantially uniform along the masonry longitudinal length, a masonry top surface, the masonry top surface being substantially planar, a masonry bottom surface, the masonry bottom surface being substantially planar, a masonry height which is essentially one half the longitudinal length and which is measured between the masonry top and masonry bottom surfaces, the masonry height being substantially uniform along the masonry longitudinal length, a first through-cavity formed through the masonry unit from the top surface to the bottom surface, a second through-cavity formed through the masonry unit from the top surface to the bottom surface, a third through-cavity formed through the masonry unit from the top surface to the bottom surface, and an anchor bar channel recessed formed in the masonry top surface and oriented substantially along the masonry longitudinal length; (b) an anchor bar, the anchor bar comprising: (i) a first set of apertures, the first set of apertures comprising a first non-threaded aperture and a first threaded aperture, wherein the first non-threaded aperture and the first threaded aperture are located in first and second diagonally opposing quadrants of a coordinate system defined by a longitudinal centerline of the anchor bar and a line that is perpendicular to the longitudinal centerline; and (ii) a second set of apertures neighboring the first set of apertures, the second set of apertures comprising a second non-threaded aperture that is substantially the same as the first non-threaded aperture, and a second threaded aperture that is substantially the same as the first threaded aperture, wherein the second non-threaded aperture and the second threaded aperture are located in third and fourth diagonally opposing quadrants of the coordinate system but spaced longitudinally from the first set of apertures wherein the first set of apertures is aligned with the first through-cavity and the second set of apertures is aligned with the third through-cavity when the anchor bar is placed into the anchor bar recessed channel of the masonry unit and wherein a width of the anchor bar is smaller than a width of the recessed channel of the masonry unit; and (c) a fastener, the fastener comprising: (i) a first fastener end and a second fastener end, (ii) a head portion at the first fastener end, (iii) a stem portion rigidly affixed to the head portion, the stem portion comprising a threaded portion at the second fastener end wherein the head portion does not fit through the first non-threaded aperture, wherein the stem portion slides freely through the first non-threaded aperture, and wherein the threaded portion is configured to thread ably engage the first threaded aperture wherein the mechanical secured block building system can be assembled in unique ways due to a cube effect of the masonry block to construct multiple width walls, grade beams, and horizontal decks.

An alternative embodiment includes the previously described mechanical secured block building system further comprised of: (d) a footer block, the footer block being made of concrete and comprising: a footer longitudinal length substantially the same as the masonry longitudinal length; a footer width measured perpendicularly to the footer longitudinal length and essentially one half the longitudinal length, wherein the footer width is substantially uniform along the footer longitudinal length, a footer top surface, the footer top surface being substantially planar, a footer bottom surface, the footer bottom surface being substantially planar, a footer height measured between the footer top and footer bottom surfaces, the footer height being substantially uniform along the footer longitudinal length, a footer recess formed on the footer bottom surface, and a footer through-hole formed from the footer top surface to the footer recess; and (e) a footer plate, the footer plate comprising: a footer threaded aperture, the footer threaded aperture configured to threadably engage the threaded portion of a lower most fastener, wherein the footer plate fits within the footer recess such that, when received by the footer recess, the footer plate does not protrude below the second bottom surface and the footer plate is substantially prevented from rotating within the footer recess.

FIGS. 1 A through 1 C are sketches of the general mechanical block special enhancements, of multi walls 30, grade beams 60, 71 and horizontal beam/slabs 80. The components of the sketches are described in the following paragraphs.

FIGS. 2 A through 2 C are sketches of mechanical systems for unitized post tensioning block 135, longer bar 133A and fastener 134 components plus a method 138 to assemble a typical wall. Assembly Process for FIG. 2 C:

| Step | Description |
|---|---|
| 1 | Place footer block and insert two starter bar nuts, then invert the footer block. |
| 2 | Place CMU 135 over the starter anchor/bars 133 |
| 3 | Align CMU 135 with footer block |
| 4 | Place two additional footer blocks and an additional CMU135. Slide the CMUs 135 as they split the footer blocks (ie - half a CMU135 on each of two footers) |
| 5 | Place bar and bolts onto the CMUs 135 and tighten the two tendon/through bolts 134 into the threaded apertures in the lowermost starter anchor/bars 133 by means of a wrench or equal which secure the uppermost bar 133 in a tensioned condition with the CMU135 |
| 6 | Place an additional CMU135 next to the first two CMUs135 |
| 7 | Place the second CMU 135 over the second set of starter anchor/bars 133; then place an one or more anchor/bars 133 or extended bars 133A into the upper extended recessed channels 136 of the second course of CMUs135, place at least two more tendon/through bolts 134 into the through apertures in the uppermost anchor/bars 33 of the second CMU 135 |
| 8 | Repeat as needed. |

FIGS. 3 A through 3 D are sketches of the mechanical systems for unitized post tensioning from a Top, Side, End and Isometric perspective. The features depicted include the ducts 137 and the recess space 136. The overall strength of the demonstrated block 135 is 4000 psi or greater based on the ASTM C 140 specification. One also notes the block length BL; block width BW=approximately ½ block length BL; the block height BH=Block width BW=approximately ½ block length BL; and the distance BC13 from centerline of core 1 and core 3 and Centerlines C of anchor bar apertures.

FIGS. 4 A through 4 D are sketches of the bars for the mechanical systems for unitized post tensioning building systems. Shown in these sketches are an anchor bar 133, extended, relatively longer anchor bar 133A, a bar/anchor aperture pattern 180, one distance X from center point C, a second distance Y from center point C, the center point C, an anchor bar width W; and an anchor bar length L.

FIGS. 5 A through 5 C are sketches of the general MSB walls single 31, double 32, and triple 33. Multiple width walls inter-connected by perpendicularly placed courses and/or link bars. The multiple width walls inter-connected by perpendicularly placed courses of block 36 and/or link bars 50. These are complemented by the normal securing bar 40 or perpendicular securing bars 41 at wider positions such as corners and at piers 34. One skilled in the art well appreciates there may be two, three, four or more rows. The major improved configuration utilizes a cube of designed block where the block length BL equals two times the block width BW. The cubing is complete in all three directions with the block width BW equal to the block height BH. The additional width structurally improves the strength. The interlocking perpendicularly of the courses from one contiguous wall to the next one beside it (the face of the contiguous block are touching) permits an even greater strength from the separate walls being integrally fastened to each other with interlocked block and anchor bars.

FIGS. 6 A through 6 D are sketches of additional multi walls 31, 32, 33 and piers 34 for the mechanical secured block building system (MSB) wall system. The components shown are described above. Here are shown the manner to interconnect piers 34 with the walls in different directions as well as creating cubed piers for stand-alone uses (such as piers as building columns supporting floor decks, roof decks, structural beams and other building structures.

FIGS. 7 A through 7 D are more sketches of mechanical secured block building system (MSB) wall system walls and components. The components have been described. One may especially note the long bars 40, the perpendicular bars 41 and the link bars 50.

Figure 8:
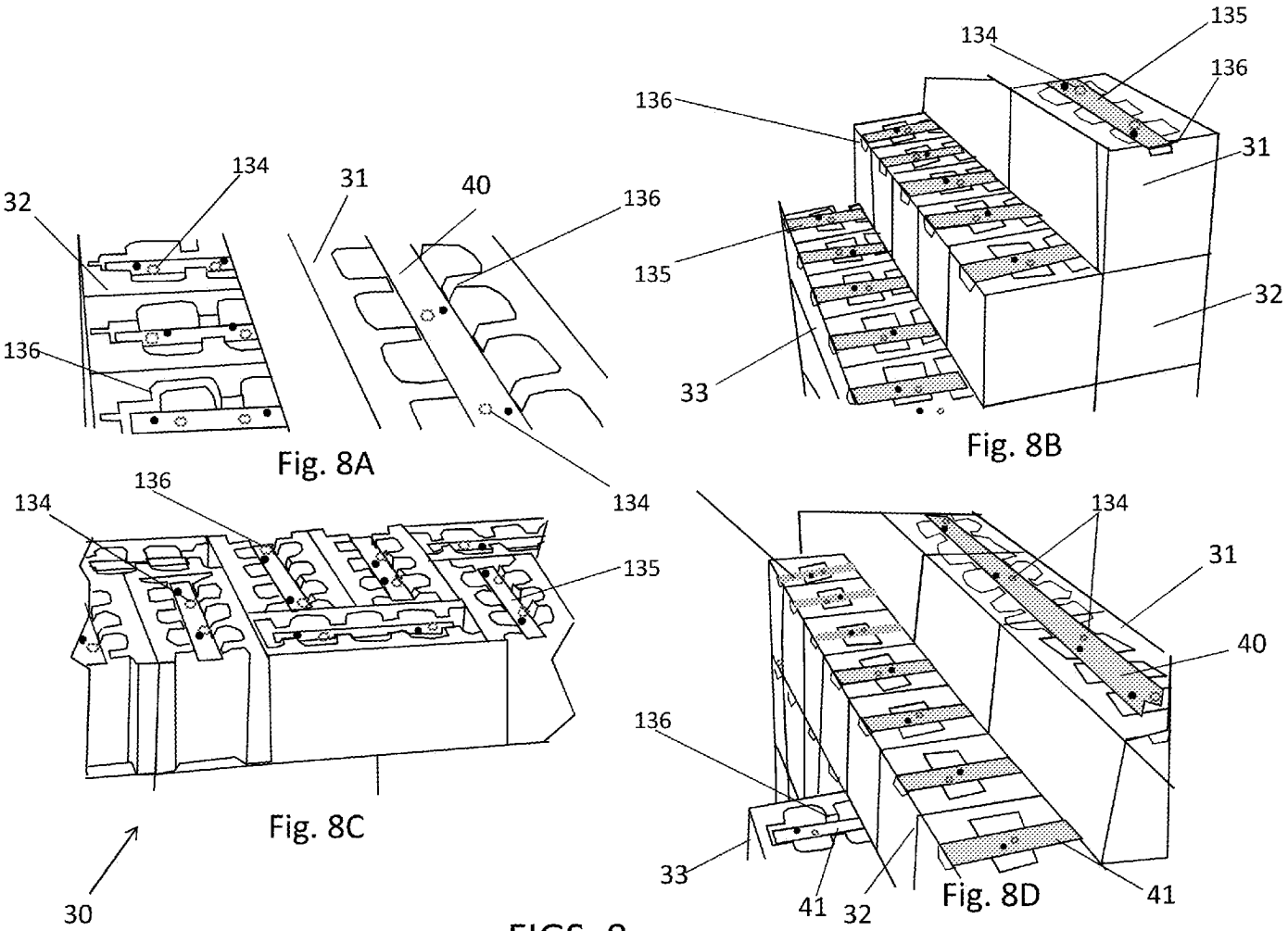
FIG. 8A is a first perspective view of the MSB walls with components and features shown from generally a side or perspective views.
FIG. 8B is a second perspective view of the MSB walls with components and features shown from generally a side or perspective views.
FIG. 8C is a third perspective view of the MSB walls with components and features shown from generally a side or perspective views.
FIG. 8D is a fourth perspective view of the MSB walls with components and features shown from generally a side or perspective views.

FIGS. 8 A through 8 D are sketches of the mechanical secured block building system (MSB) wall system with additional multi walls 31, 32, 33 components and features shown from generally a side, top and perspective views.

Figure 9:
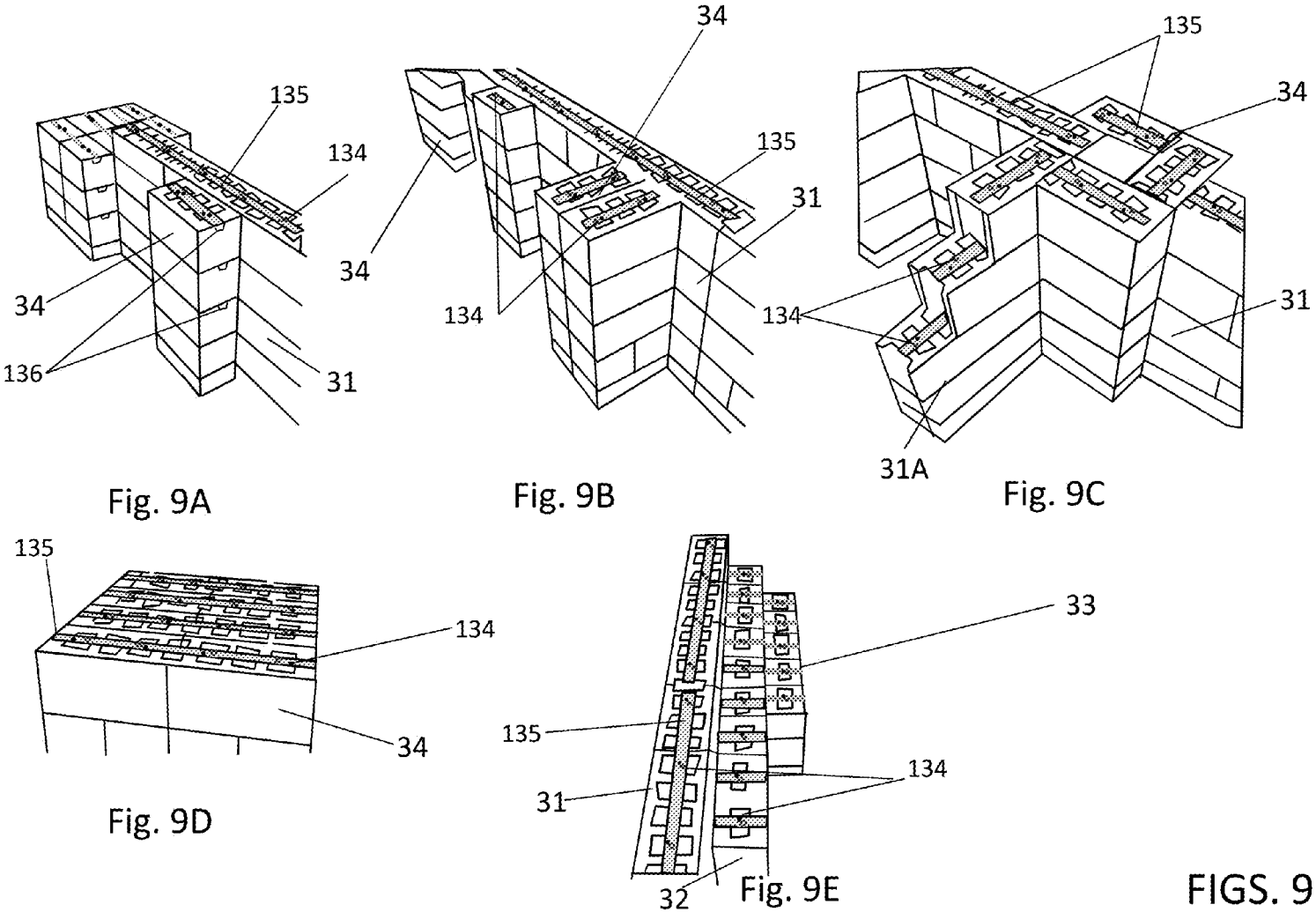
FIG. 9A is a first perspective view of the MSB walls made into various sized piers.
FIG. 9B is a second perspective view of the MSB walls made into various sized piers.
FIG. 9C is a third perspective view of the MSB walls made into various sized piers.
FIG. 9D is a fourth perspective view of the MSB walls made into various sized piers.
FIG. 9E is a fifth perspective view of the MSB walls made into various sized piers.

FIG. 9 A through 9 E are sketches of the MSB walls made into various sized piers. Note the cubing shows two block pier configurations in FIG. 9 A; three block configuration in FIG. 9 B; four block configuration in FIG. 9 C with an open cavity or chase (for utilities, pipe, columns and the like); solid eight block configuration in FIG. 9 D; and a three width wall in FIG. 9 E.

Figures 10, 10A, 10B, 10C:
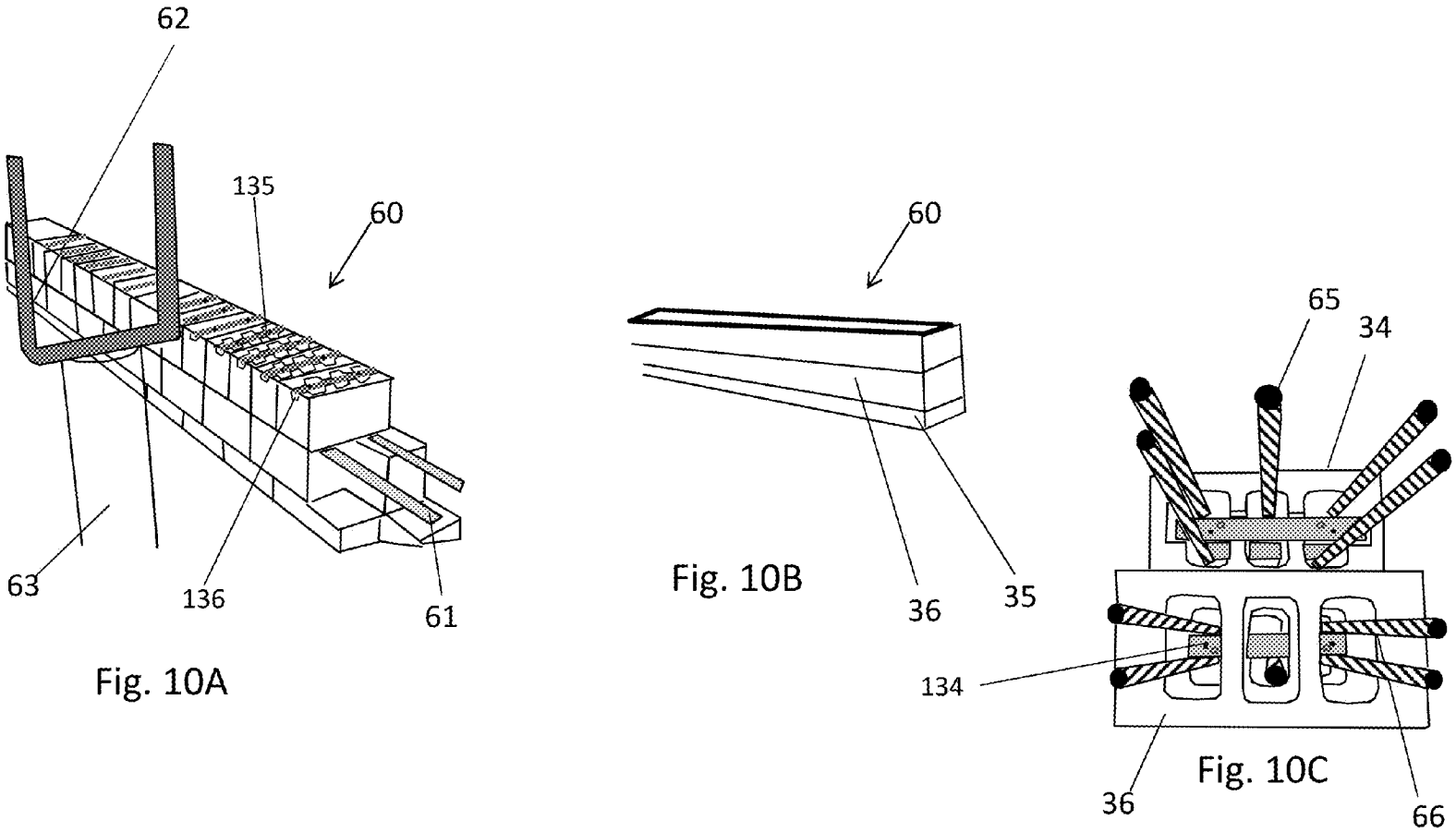
FIG. 10A is a first perspective view of the general grade beams made from MSB.
FIG. 10B is a second perspective view of the general grade beams made from MSB.
FIG. 10C is a third perspective view of the general grade beams made from MSB.

FIG. 10 A through 10 C are sketches of the general grade beams 60 made from mechanical secured block building system (MSB) wall system. The multiple width grade beams 60 with potential pier 34 connections or connection to pilings/posts 63 for bridging low capacity bearing conditions such as a bog, marsh, former lake bed, etc. The grade beam 60 shown utilizes cube of designed block (length equals 2× the width and height). The beam 60 has a long, continuous tension bar 61 along the bottom of the block 36 or footer 35. One means to connect the beam 60 to the piling 63 is to use a "U-like" cradle 62 that is secured to the top of the pilings 63 and the side face of the blocks 36 of the grade beam 60. Where the beam 60 connects with posts or columns above, there can be a series of rebar tendons 65 placed in the cavity of the mechanical secured block building system (MSB) columns. The rebar 65 is then grouted in place in the void 65 around the rebar 65 and in the block unit cavities. One skilled in the art of building construction appreciates the ability to vary the size of the rebar 65, the strength of the grout and the area of the column or long piers 34 to achieve the needed column strength and, importantly, the moment resistance at the beam and column junction.

Figure 11:
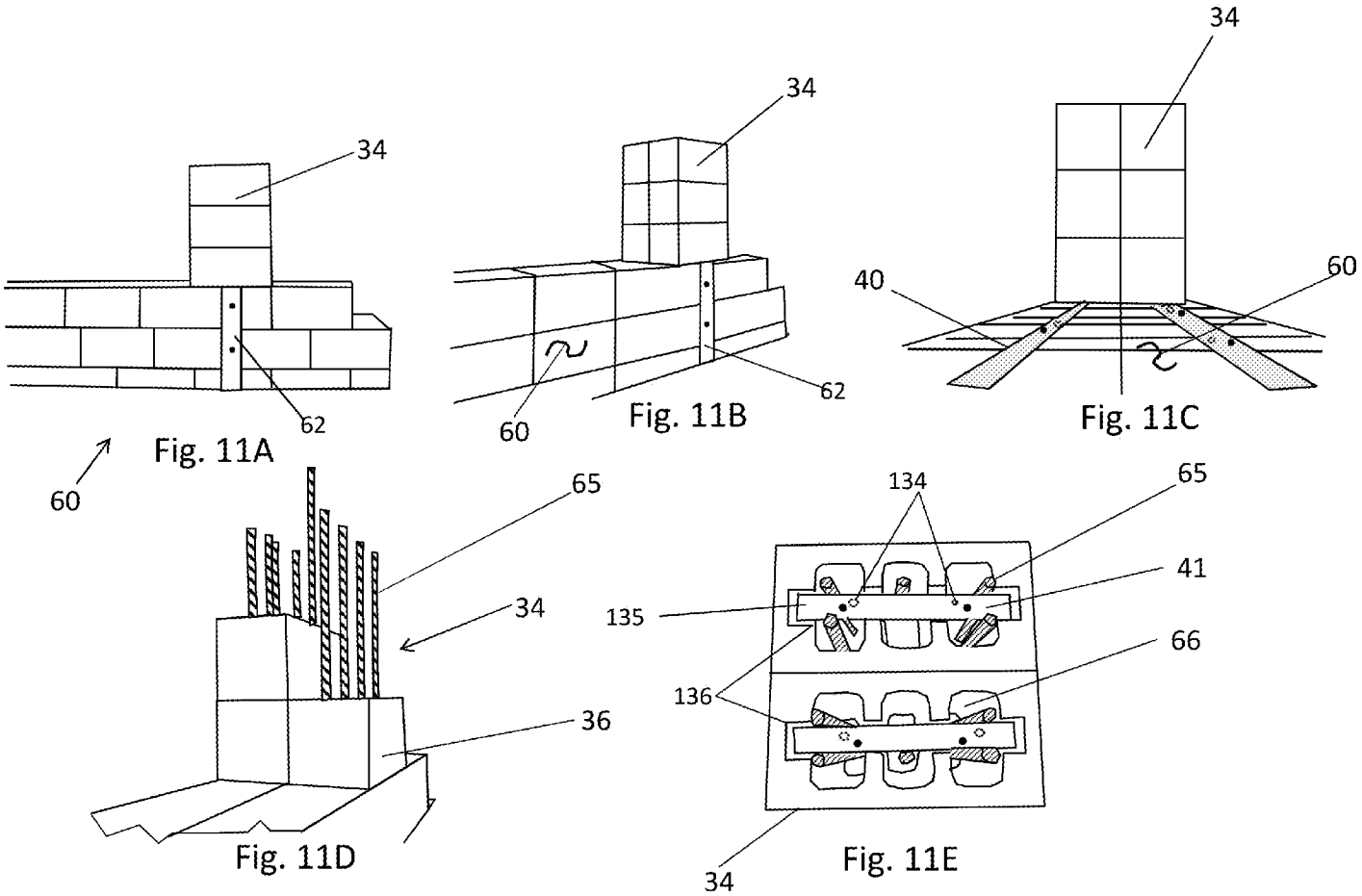
FIG. 11A is a first perspective view of grade beams made from MSB.
FIG. 11B is a second perspective view of grade beams made from MSB.
FIG. 11C is a third perspective view of grade beams made from MSB.
FIG. 11D is a fourth perspective view of grade beams made from MSB.
FIG. 11E is a fifth perspective view of grade beams made from MSB.

FIG. 11 A through 11 E are sketches of grade beams 60 made from mechanical secured block building system (MSB) wall system. One can appreciate the pier 34 at the beam 60, the block 36, the voids 65 for grout, and the bars 41.

FIG. 12 A through 12 F are additional sketches of the grade beams made from mechanical secured block building system (MSB) wall system. The components shown have been identified and discussed above.

FIGS. 13 A and 13 B are sketches of a grade beam. FIG. 13 A is an engineering drawing for the grade beam 60. FIG. 13 B is a sketch of a grade beam 60 used in the "Make-It-Right" rebuilding efforts in New Orleans, La., where nearly 4,000 homes in Lower 9th Ward were destroyed by Hurricane Katrina. These grade beams reduce build time as much as four (4) weeks—even more when one factors in weather conditions.

FIG. 14 A through 14 D are additional engineering drawings of the grade beams 60 from mechanical secured block building system (MSB) wall system with components and configurations already discussed above.

Figures 16, 16A:
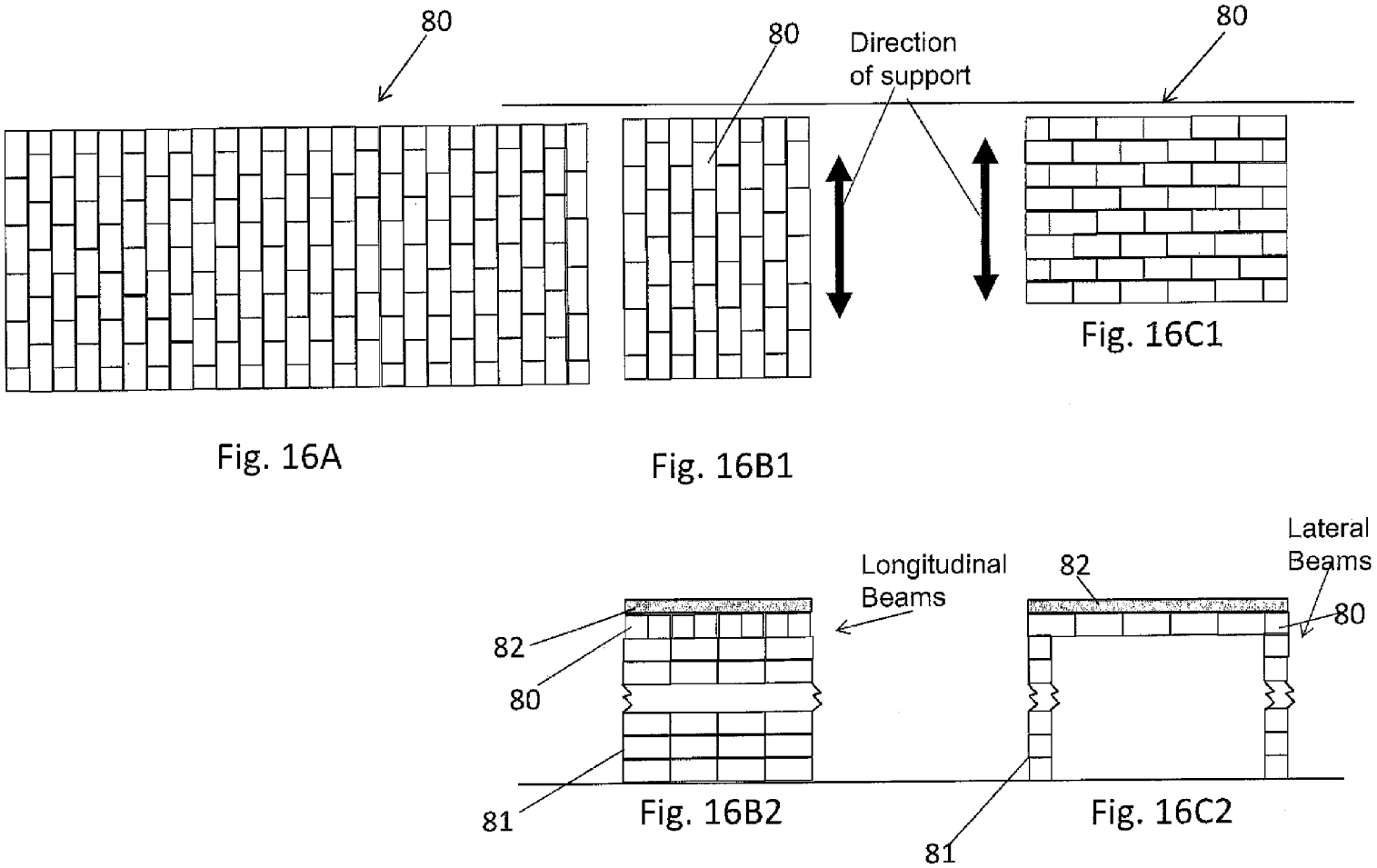
FIG. 16A is a first elevation of the horizontal beam/slabs for MSB systems.

FIG. 15 A through 15 D and FIG. 16 A through 16 C are sketches of horizontal Beams/Slabs 80 of the mechanical secured block building system (MSB) wall system. The multiple width beams 80 used for floor and ceiling support on building—single and multiple story. These may be in run parallel in direction of support columns/walls or run perpendicularly. Above the beams are standard flooring or roof membranes and structures. The slabs 80 extend across beams 82 as floor or roof decks 82 or on vertical wall 81 systems or columns. To vary the strength of the slabs, the tendon and anchor bar dimensions cam be changed. The standard 5/16 diameter and thicknesses can be increased to provide additional tension capacity of the steel and concrete combination.

The details mentioned here are exemplary and not limiting. Other specific components and manners specific to describing novel technology may be added as a person having ordinary skill in the field of construction block and wall systems and devices and their uses well appreciates.

Operation

The novel technology have been described in the above embodiment. The manner of how the device operates is described below. One notes well that the description above fully illustrates the concept of the novel technology. The manner of use is well documents and shown in the drawings described above. The anchor bars 133,133A are placed into the block recesses, and then the tendon/bolts 134 are assembled. The method shown in FIG. 2 C is essentially the manner of use. The difference for the multi-walls are running courses of block perpendicular and locking with the perpendicular bars 41 into the long bars 40, 133A or utilizing link bars 50. With the grade beams 60 and horizontal decks 80, one modifies the build to accommodate the long tension bars 61, the cradle 62 and the rebar 65. Likewise for the slabs, the intersection with vertical walls 81 may require connections between the bars and tendons.

With this description it is to be understood that the novel technology is not to be limited to only the disclosed embodiment of product. The features of the novel technology are intended to cover various modifications and equivalent arrangements included within the spirit and scope of the description.

While certain novel features of this novel technology have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present novel technology. Without further analysis, the foregoing will so fully reveal the gist of the present novel technology that others can, by applying current knowledge, readily adapt it for various applications without omitting features that, from the standpoint of prior art, fairly constitute essential characteristics of the generic or specific aspects of this novel technology.

Unless defined otherwise, all technical and scientific terms used herein have the same meaning as commonly understood by one of ordinary skill in the art to which these novel technologies belong. Although any methods and materials similar or equivalent to those described herein can also be used in the practice or testing of the present novel technologies, the preferred methods and materials are now described above in the foregoing paragraphs.

Other embodiments of the novel technology are possible. Although the description above contains much specificity, these should not be construed as limiting the scope of the novel technology, but as merely providing illustrations of some of the presently preferred embodiments of this novel technology. It is also contemplated that various combinations or sub-combinations of the specific features and aspects of the embodiments may be made and still fall within the scope of the novel technologies. It should be understood that various features and aspects of the disclosed embodiments can be combined with or substituted for one another in order to form varying modes of the disclosed novel technologies. Thus, it is intended that the scope of at least some of the present novel technologies herein disclosed should not be limited by the particular disclosed embodiments described above.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "novel technology," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

Various modifications and additions can be made to the exemplary embodiments discussed without departing from the scope of the present novel technology. For example, while the embodiments described above refer to particular features, the scope of this novel technology also includes embodiments having different combinations of features and embodiments that do not include all of the described features. Accordingly, the scope of the present novel technology is intended to embrace all such alternatives, modifications, and variations as fall within the scope of the claims, together with all equivalents thereof.

What is claimed is:

1. A mechanical secured block building system for constructing structures with concrete masonry units, the system comprising:

(a) a masonry unit, the masonry unit being made of concrete and comprising: a masonry longitudinal length, a masonry width measured perpendicularly to the masonry longitudinal length, wherein the masonry width which is substantially one half the longitudinal length and which is substantially uniform along the masonry longitudinal length, a masonry top surface, the masonry top surface being substantially planar, a masonry bottom surface, the masonry bottom surface being substantially planar, a masonry height which is substantially one half the longitudinal length and which is measured between the masonry top and masonry bottom surfaces, the masonry height being substantially uniform along the masonry longitudinal length, a first through-cavity formed through the masonry unit from the top surface to the bottom surface, a second through-cavity formed through the masonry unit from the top surface to the bottom surface, a third through-cavity formed through the masonry unit from the top surface to the bottom surface, and an anchor bar recessed channel formed in the masonry top surface and oriented substantially along the masonry longitudinal length;

(b) an anchor bar, the anchor bar comprising:

(i) a first set of apertures, the first set of apertures comprising a first non-threaded aperture and a first threaded aperture, wherein the first non-threaded aperture and the first threaded aperture are located in first and second diagonally opposing quadrants of a coordinate system defined by a longitudinal centerline of the anchor bar and a line that is perpendicular to the longitudinal centerline; and (ii) a second set of apertures neighboring the first set of apertures, the second set of apertures comprising a second non-threaded aperture that is substantially the same as the first non-threaded aperture, and a second threaded aperture that is substantially the same as the first threaded aperture, wherein the second non-threaded aperture and the second threaded aperture are located in third and fourth diagonally opposing quadrants of the coordinate system but spaced longitudinally from the first set of apertures, wherein the first set of apertures is aligned with the first through-cavity and the second set of apertures is aligned with the third through-cavity when the anchor bar is placed into the anchor bar recessed channel of the masonry unit and wherein a width of the anchor bar is smaller than a width of the recessed channel of the masonry unit; and (c) a fastener, the fastener comprising:

(i) a first fastener end and a second fastener end, (ii) a head portion at the first fastener end, (iii) a stem portion rigidly affixed to the head portion, the stem portion comprising a threaded portion at the second fastener end wherein the head portion does not fit through the first non-threaded aperture wherein the stem portion slides freely through the first non-threaded aperture, and wherein the threaded portion is configured to threadably engage the first threaded aperture whereby the mechanical secured block building system can be assembled in unique ways due to a cube effect of the masonry block to construct multiple width walls, grade beams, and horizontal decks.

2. The mechanical secured block building system in claim 1 further comprising:

(d) a footer block, the footer block being made of concrete and comprising: a footer longitudinal length substantially the same as the masonry longitudinal length; a footer width measured perpendicularly to the footer longitudinal length and substantially one half the longitudinal length, wherein the footer width is substantially uniform along the footer longitudinal length, a footer top surface, the footer top surface being substantially planar, a footer bottom surface, the footer bottom surface being substantially planar, a footer height measured between the footer top and footer bottom surfaces, the footer height being substantially uniform along the footer longitudinal length, a footer recess formed on the footer bottom surface, and a footer through-hole formed from the footer top surface to the footer recess; and (e) a footer plate, the footer plate comprising: a footer threaded aperture, the footer threaded aperture configured to threadably engage the threaded portion of the lower most fastener, wherein the footer plate fits within the footer recess such that, when received by the footer recess, the footer plate does not protrude below the second bottom surface and the footer plate is substantially prevented from rotating within the footer recess.

3. The mechanical secured block building system of claim 1, wherein the masonry unit is one of a plurality of the same masonry units, wherein the anchor bar is one of a plurality of the same anchor bars, and wherein the fastener is one of a plurality of the same fasteners, the pluralities of masonry units, anchor bars, and fasteners forming a corner of a wall structure having multiple levels, wherein each anchor bar of the plurality of anchor bars at the corner overlaps vertically at a substantially right angle with the anchor bars of the plurality of anchor bars at the levels above and below.

4. The mechanical secured block building system of claim 1 wherein the plurality of wall systems further comprises at least a first wall system and a second wall system and wherein each of the first and second wall system is further comprised of a plurality of block courses and each are placed contiguously as touching wall systems and wherein the second wall system has alternating longitudinal and perpendicular blocks that intersect and connect with the first wall system through a perpendicular block unit and anchor bar to create an integral wall system of multiple walls.

5. The mechanical secured block building system of claim 4 wherein a pier comprised of the plurality of block units are placed perpendicular to other blocks and in courses along a longitudinal run of the wall systems.

6. The mechanical secured block building system of claim 1 wherein a pier comprised of plurality of block units are placed perpendicular to other blocks and in courses along a longitudinal run of the wall system.

7. The mechanical secured block building system of claim 1 whereby the wall system is placed substantially horizontal to the ground wherein a strong, flat structure results which may be used as a deck, floor and roof structure.

8. A construction system for building a masonry structure with unitized post tensioning reinforcement, the system comprising:

a) a plurality of concrete masonry units where the units have a length equal to two times a unit's width and the unit's width is equal to the unit's height, each unit with at least one cavity, each unit having an uppermost and lowermost plane with the hollow cavity therein, and each unit having the planes being substantially parallel to one another;

b) a series of elongated anchor bars that are comprised of a durable material, each anchor bar with a threaded aperture and a comparatively larger non-threaded aperture, the first bar placed contiguously to the first plane having the hollow cavity of the masonry unit and the second bar placed contiguously to the uppermost top plane having the hollow cavity of the masonry unit wherein the first bar and second bar are placed substantially parallel to each other with the apertures aligned such that the non-threaded aperture of the uppermost bar is aligned with the threaded aperture of the lowermost bar;

c) a plurality of fasteners made of a durable material and the fasteners acting as tendons with a means to rigidly and removably connect each of the anchor bars first to the bar aligned above, if any, and secondly to the bar below with the masonry unit interposed between the connected bars;

whereby the mechanical secured block building system can be assembled in unique ways due to a cube effect of the masonry block to construct multiple width walls, grade beams, and horizontal decks.

* * * * *